United States Patent [19]

German et al.

[11] Patent Number: 5,000,779

[45] Date of Patent: Mar. 19, 1991

[54] PALLADIUM BASED POWDER-METAL ALLOYS AND METHOD FOR MAKING SAME

[75] Inventors: Randall M. German, Latham, N.Y.; Laura L. Bourguignon, East Providence, R.I.; Dwarika P. Agarwal, Attleboro, Mass.; Shaji Faroog, Troy, N.Y.

[73] Assignee: Leach & Garner, N. Attleboro, Mass.

[21] Appl. No.: 195,721

[22] Filed: May 18, 1988

[51] Int. Cl.[5] ..... C22C 21/14

[52] U.S. Cl. ..... 75/244; 75/247; 419/12; 419/23; 420/464; 420/497; 420/502; 420/505; 420/503

[58] Field of Search ..... 419/12, 23; 75/244, 75/247; 420/502, 464, 503, 497, 505

[56] References Cited

U.S. PATENT DOCUMENTS

| | | | |
|---|---|---|---|
| 2,048,648 | 7/1936 | Feussner et al. | 148/13 |
| 2,095,890 | 10/1937 | Powell | 120/109 |
| 2,138,599 | 11/1938 | Gwyn | 200/166 |
| 4,149,883 | 4/1979 | Harmsen et al. | 75/173 |

FOREIGN PATENT DOCUMENTS

| | | |
|---|---|---|
| 0058622 | 5/1979 | Japan . |
| 0139663 | 9/1984 | Japan . |

OTHER PUBLICATIONS

Platinum Metals Review, p. 44, 1988, vol. 32.

*Primary Examiner*—Stephen J. Lechert, Jr.
*Assistant Examiner*—N. Bhat
*Attorney, Agent, or Firm*—George W. Dishong

[57] ABSTRACT

The subject of this invention is the development of new alloys along with new processing approaches for the utilization of the alloys. A particular class of alloys comprises at least one noble metal selected from the group comprising gold, palladium, silver and copper and an amount of between about 0.20 weight percent and about 0.80 weight percent of at least one metalloid selected from the group of metalloids consisting of boron, phosphorous, silicon and lithium. Rapid solidification technology in powder fabrication and the addition of metalloids have been combined to produce a new class of palladium based alloys. The metalloid additions greatly increase the hardness, enhance the fine grain structure and aid sintering densification. Net-shape forming is a benefit derived from the characteristics of the new alloys.

6 Claims, No Drawings

PALLADIUM BASED POWDER-METAL ALLOYS AND METHOD FOR MAKING SAME

BACKGROUND OF THE INVENTION

1. Field of the Invention

The present invention is concerned most generally with metals and alloys of metals having added thereto metalloids which enhances the preparation of metal powders made from the modified metal or metal alloys and improves the properties of the metal powders when used in the forming of or net-shape forming of articles from the metal or alloys by processes such as supersolidus sintering. More particularly the present invention is directed to palladium-silver-copper alloy compositions of increased hardness containing metalloids which improve certain characteristics of the alloys. The overall hardness of the basic alloy is increased, the supersolidus temperature is reduced thereby aiding in the supersolidus sintering process, the initial grain size in powder particles of the alloy is reduced and upon atomization and rapid solidification the powder metal produced thereby has optimum particle and grain size for use in supersolidus sintering for the net-shape forming of articles made using the alloy powder.

2. Description of the Prior Art

One of the motivations for the development of the invention herein disclosed was the need for high hardness, wear resistant and low resistivity electrical contacts. Because of the problems and costs associated with the current technology, new approaches were considered and as a consequence of the research the present invention was discovered. It is understood that there are more applications for the products and the processes of the present invention than the making of useful and superior electrical contacts; however, electrical contacts and the problems associated with the present state of the art are used in discussing the prior art.

Alloys based on the noble metals are important in forming low-energy electrical contacts in modern electrical systems. The noble metals resist oxidation and corrosion, while exhibiting high electrical conductivities. Because of this combination of properties, the noble metals are used routinely in systems containing semiconducting components. Alloys with high contact resistance, upon the closing of a contact would produce or result in voltage surges due to the high initial transient resistance which alloys having high contact resistance would possess. Such surges are fatal to semiconductors. Thus, there is a natural marriage of semiconducting materials and noble metals used for interconnections. For these reasons the noble metal alloys are used in potentiometer contacts, sliding contacts, commutators, circuit probes, slip rings, make-and-break contacts, and various relays or switches.

Over the years, the needed properties of noble metal low-energy electrical contact alloys have been established. Important requirements are a low contact resistance, resistance to oxidation, tarnish, and polymerization of organic vapors, high electrical and thermal conductivity, high elastic modulus, high strength, and wear resistance. Most of these properties are easily attained with noble metal alloys, but wear resistance requires a high alloy hardness. Since the noble metals exhibit ordering phases, it is common to rely on alloying additions that promote a high hardness through precipitation or ordering. Because of cost, and these other criteria related to the desireable properties of the material, the usual alloy formulation relies on mixtures of common high conductivity metals. One of the most successful alloy groups is located near the center of the palladium-silver-copper ternary. These alloys have sufficient nobility to protect against tarnish and corrosion in most industrial atmospheres. The mechanical properties of the alloys can be altered over a considerable range depending on the degree of ordering induced through heat treatments. Thus, component fabrication is aided by the low strength and high ductility found in the disordered state, and wear resistance in service is aided by the high strength found in the ordered state.

There are factors associated with noble metal alloys that prove to be a continual source of problems. First is the cost of the raw material. The manufacturing sequence to form a final product from ingot material requires time, and with expensive material there is a desire for rapid inventory turnover. Since fabrication involves waste and recycling, net-shape forming approaches, such as powder metallurgy, have merit in rapid product fabrication with minimal waste. Furthermore, the palladium-silver-copper alloys exhibit high work hardening rates. The traditional metalworking techniques involved in fabrication of contacts require a large number of long anneals to eliminate the work hardening. Consequently, compromises in component design, alloying, and product performance occur in order to minimize manufacturing problems.

The following patents are representative of the developments in recent years. Note that none of the patents discussed anticipate the alloy powder of the instant invention nor do they have the particular characteristics herein described. Clearly, Pd-Cu-Ag alloys are well known and are said to be useful for electrical contacts. For example, see U.S. Pat. Nos. 2,187,378 and 4,149,883.

The Japanese appear to be particularly active in this field. Note from the abstracts of the Japanese patents that Pd-Cu-Ag alloys are known for various uses including use as an electrical contact material. However, none of the abstracts disclose the particular alloy defined and described herein.

The abstract of Japanese Pat. No. 52-47516 discloses an electrical contact alloy containing 30–50% Pd; 10–50% Ag and 10–55% Cu. An alloy for use as an electrical contact containing 5–30% Ag, 5–30% Cu and 50–95% Pd is described in Japanese Pat. No. 53-48168.

The abstract of Japanese Pat. Nos. 59-107048; 59-107049 and 59-107050 disclose slide contact material containing 30–50% Pd; 20–40% Ag and 20–40% Cu. An additional ingredient is added to each of the alloys described in these three Japanese patents. In 59-107048 the additional ingredient may be boron. Note however, that there is no suggestion to add boron and phosphorous to the composition or to select the more particular amount of Pd-Ag and Cu used in the instant invention. Even more importantly, it should be noted that the use of the metalloids such as boron and/or phosphorous in this prior art and others is as a deoxidizer and as such the amounts of the metalloids is almost an order of magnitude less than the amount taught and claimed herein. In fact if too much metalloid is used in the process where deoxidation is desired the process of making the alloy is hindered. What is being taught and claimed in the present specification is antithetical to the teaching of the prior art. In the instant invention it is desireable to have the lower melting temperature as an aid in the supersolidus sintering process. In addition, there is no teaching in these three patent abstracts to form the alloy into a powder having the particular grain size and melting characteristics which make it particularly suitable to supersolidus sintering techniques.

U.S. Pat. No. 1,935,897 and British Pat. No. 354,216 disclose a Pd-Cu-Ag alloy which may contain a metalloid deoxidizer such as boron. The inclusion of phosphorous in addition to boron is not suggested. There is also no suggestion for selecting the particular range of ingredients nor of forming the alloy into a powder having the characteristic grain size and melting properties found in the alloy powder of the present invention.

The application of powder metallurgy to noble metal electrical contact alloys provides a possible solution to several problems. First, the economic factors of rapid inventory turnover, minimized scrap, and easy material recycling are very favorable. Second, the reduced number of manufacturing steps greatly aids productivity, since direct shaping is possible. This decreases the time that valuable material is in processing and decreases the inventory control problems inherent with precious metals. Third, the benefits of new compositional possibilities cannot be overlooked. Since deformation is not needed and work hardening is not a concern, new high hardness compositions can be processed by powder metallurgy. Previously, these compositions were unavailable because of processing constraints.

The development of new alloys with new processing approaches is the object of this invention. There has been combined, rapid solidification technology in powder fabrication with metalloid alloying to produce a new class of palladium-based low-energy electrical contact alloys. The metalloid additions greatly increase the hardness and aid sintering densification. Since net shape forming is an obvious component of this research, the modified alloys provide benefits and/or desireable characteristics. The instant invention opens up a wealth of opportunities in forming complex shapes out of coarse powder. The use of the coarse powder from the compositions of the present invention may indeed be ideal for full density processing by injection molding and supersolidus sintering (which is revolutionary because to the present time it has been assumed that only fine powders of 10 micrometers or less were useful in injection molding. The fine powder is a major problem, because of the long debinding time associated with the fine particle size. Many are seeking a solution to this problem.). The advantages of the present invention include lower powder fabrication costs since traditional atomization technologies will be suitable, easier handling and molding with the coarse particle size, faster processing because of rapid debinding and sintering, and better properties because of the homogeneity of the input powder.

SUMMARY OF THE INVENTION

The present invention provides for the use of metal powders having particles comprising metalloids and at least one other metal, typically a noble metal, in a supersolidus sintering process which results in an article which is substantially net-shape formed. The present invention is also directed to a metal or an alloy of metals doped with typically two metalloids. Such metalloid additions unexpectedly enhances the properties of the doped alloy which properties allow for the making of metal powders having small initial grain size, large particle size and a lower solidus temperature all of which improve the sinterability and the compaction of such powders when used to substantially net-shape form articles from such doped alloy powders.

It is therefore a primary object of the present invention to provide a process for net-shape forming of articles of manufacture, out of doped noble metals using substantially spherical shaped particles, the particles having small grain size, comprising the steps of: doping the metal with an amount of at least one metalloid selected from the group of metalloids consisting of boron, phosphorous, silicon and lithium to obtain said doped metal; melting the doped metal; gas atomizing the melted doped metal; cooling rapidly the gas atomized doped metal thereby producing the substantially spherical powder particles having small grain size; compacting the powder particles into the configuration of the article of manufacture; heating the compact for a time and to a temperature depending upon the doped noble metal the temperature between the solidus temperature and the liquidus temperature of the doped metal; and cooling the heated compact thereby net-shape forming the article of manufacture.

It is another primary object of the present invention to provide a process for net-shape forming of articles of manufacture, out of doped noble metal alloys using substantially spherical shaped particles, the particles having small grain size, comprising the steps of: forming a noble metal alloy; doping the alloy with an amount of at least one metalloid selected from the group of metalloids consisting of boron, phosphorous, silicon and lithium to obtain said doped metal alloy; melting the doped alloy; gas atomizing the melted doped alloy; cooling rapidly, typically water quenching, the gas atomized doped alloy thereby producing the substantially spherical powder particles having small grain size; compacting the powder particles into the configuration of the article of manufacture; heating the compact for a time depending upon said doped noble metal alloy and to a temperature between the solidus temperature and the liquidus temperature of the doped alloy; and cooling the heated compact thereby net-shape forming the article of manufacture.

Further primary objects of the present invention are provide articles of manufacture produced by a processes for net-shape forming of articles of manufacture, out of doped noble metals or doped metal alloys using substantially spherical shaped particles, the particles having small grain size, comprising substantially the steps of the processes listed above.

A still further primary object of the present invention is to provide an alloy composition of matter comprising: at least one noble metal selected from the group comprising gold, palladium, silver and copper; and an amount or between about 0.20 weight percent and about 0.80 weight percent of at least one metalloid selected from the group of metalloids consisting of boron, phosphorous, silicon and lithium.

Other objects of the present invention are to provide a noble metal alloy comprising: less than 60.0 weight percent palladium; less than 60.0 weight percent silver; less than 60.0 weight percent copper; less than 0.80 weight percent boron; and less than 0.80 weight percent phosphorous.

Other objects of the present invention will be apparent to those of ordinary skill in the art upon reading the following detailed description of the invention.

DESCRIPTION OF THE PREFERRED EMBODIMENTS

The application of the invention to use in the making of electrical contacts will be discussed in detail in order to describe the various aspects of the present invention. It should be clearly noted that the potential for using rapid solidification technology in powder fabrication with metalloid additions along with the supersolidus sintering concept with binder assisted molding goes beyond the narrow application to electrical contacts. The process and the compositions are applicable to injection molding and the properties are very interesting and attractive and offer some significant and new opportunities for advanced materials processing. The opportunities are not restricted to the particular alloys described herein; rather, there is a possible widespread use for the technology and generic concepts disclosed for forming several material systems.

The palladium-silver-copper system is used to demonstrate the advantages of supersolidus sintering techniques applied to rapidly solidified powders. Metalloids are added to enhance fine grain structure as well as aid sintering. The result is a material with impressive properties for electrical contact applications and a process which provides an economical fabrication route for alloys which are difficult to form using conventional metallurgy techniques.

The preferred embodiment of the present invention is a palladium-based alloy which can be formed into articles made from powders of the alloy using powder metallurgy (P/M) techniques. The palladium alloys are desirable for many applications where hardness, wear resistance and low contact resistance/high conductivity such as for electrical contact applications. Their extremely high hardness provides superior mechanical properties, but also makes machining very difficult and costly. P/M offers an economical fabrication route which would enable the production of components which otherwise could be prohibitively expensive. This invention involves the development of a palladium based alloy which can be successfully used for the fabrication of articles, such as electrical contacts, using P/M techniques.

The alloy developed is based around 40 weight % palladium, 30 weight % silver and 30 weight % copper. This composition has been determined by previous researchers to have the highest hardness and, thus, optimum related properties. Metalloids are added to aid or assist among other things sinterability. The sintering technique chosen for this alloy is termed supersolidus sintering. This method uses a sintering temperature greater than the solidus of the alloy, which promotes formation of a liquid at grain boundaries. Grains then slide and repack under capillary forces, resulting in a fully dense material. The role of the metalloids is multipurpose: (1) Lower solidus temperature for supersolidus sintering; (2) Decrease the initial grain size in powder particles; (3) Increase overall hardness of the alloy.

Optimum conditions for supersolidus sintering are known to be large particle size with fine grain size. Powders were gas atomized and immediately water quenched by a water spray system. The resultant particles are substantially spherical (average diameter of 58 micrometers), with a very fine grain size (10 micrometers). These conditions make them ideal for the intended supersolidus sintering.

The resultant properties are measured and compared with those of materials formed using traditional metallurgy techniques. There is no sacrifice in material properties, as shown in Table 2. Table 1 lists the various alloy compositions that were tested along with some of the properties of the alloy compositions.

Powder metallurgy is an attractive method of forming metals into useful engineering shapes. Specific attractions include excellent material utilization, low inventory, rapid solidification rates, microstructural control, simple processing sequence, and net shape forming capabilities. The concept of net shape forming greatly reduces, or in some cases, eliminates machining expenses. At the same time, material waste is alleviated or at the least greatly reduced. This allows the fabrication of alloys which are difficult to form using traditional metallurgy techniques due to undesirable material properties, enabling cost-effective manufacturing of articles using these alloys. It also enables the development of new alloys which are impossible to form using other methods for reasons such as segregation during casting, solubility limits in melting, or extremely high melting temperatures.

This invention, in the preferred embodiment focuses on alloys based on the palladium-silver-copper system. Two of the currently used alloys are described in ASTM specification numbers B540 and B563. The extreme high hardness of these alloys which gives them attractive properties for electrical contact applications also makes them prohibitively expensive to manufacture. In some instances, multiple annealing cycles are required with annealing times as long as thirty hours. Powder metallurgy processing offers many advantages for this net-shape forming along with significant reductions in refining costs. Furthermore, microstructural manipulation enables the development of novel material properties. Newly developed injection molding techniques allow the formation of intricate shapes, so component design no longer has restrictions relative to shape. The palladium-silver-copper alloy system is an ideal candidate for powder metallurgy processing considering the many benefits offered.

The concept of powder metallurgy involves forming metal into very fine particles with sizes on the order of sub-micron to 100 microns. The particles are then compacted into a shape either by die compaction, isostatic pressing or injection molding. This stage often requires the use of a binder. The compact is subsequently sintered, which is a heat treatment performed below the liquidus temperature. The particles bond together, pores escape, and the compact densifies to near one hundred percent (100%) of the theoretical density.

The precious metal alloy systems have been extensively studied. Excellent property combinations are found in the simple ternaries like gold-silver-copper and palladium-silver-copper. These systems are characterized by ordering reactions that contribute considerable strengthening. Furthermore, they offer desirable properties for electrical contact applications including excellent electrical conductivity, good corrosion and wear resistance and low contact resistance. Due to cost considerations the Pd-Ag-Cu system is preferred for general applications such as low energy electrical contacts.

Previous researchers reported a Vicker's hardness number of 450 for the composition 40 wt. % Pd; 30 wt. % Ag; and 30 wt. % Cu through aging heat treatments. Therefore, early efforts related to the instant invention focused upon such a composition. The system exhibits a two phase microstructure. Although usually viewed as a problem due to casting segregation, the powder metallurgist utilizes a two phase system to enhance microstructural manipulation. Furthermore, alloying with the metalloids like boron, phosphorous, silicon and lithium provides an avenue to microstructural control for this alloy system. In addition, the metalloids lower the melting temperature, provide hardening and give a finer initial grain size. Initial experiments were performed on a twin roll quenching device. Metalloid additions were varied and the response of each composition was assessed based on microstructure, hardness, fracture, annealing, melting, conductivity and grain growth measurements. A combination of boron and phosphorus was demonstrated to be the most favorable.

It is understood that composition and sintering are interlinked in arriving at a useful final microstructure. Emphasis is focused on a new sintering process termed supersolidus sintering. During sintering, a thin liquid film forms at grain boundaries allowing grains to slide and repack under capillary forces. A combination was made of rapid solidification techniques with full density sintering. Rapid solidification would produce a fine grain size with the potential for fast sintering densification. Doping with metalloids gives a finer initial grain size, lowers the melting temperature and provides hardening. Supersolidus sintering provides a basis for densifying fine grained prealloyed powders and is especially appropriate for high performance systems. The process gives full density, without shape distortion, in short sintering cycles. However, precise temperature control is necessary to prevent microstructural coarsening during sintering. In this regard, the wide liquidus and solidus separation in the Pd-Ag-Cu system with the added metalloids is an advantage. With the appropriate metalloid additions, the system is ideal for the intended supersolidus sintering.

A two fluid atomization technique was used to produce rapidly solidified powders. The major parameters, gas pressure, superheat and nozzle diameter, are easily controlled. This powder was atomized with nitrogen gas at 200 psi (1.4 MPa). The nozzle diameter was 3 mm and the melt temperature was 1280° C. (1453° K.) with a superheat of approximately 200° K. Immediately after sintering, the powders are subjected to a secondary water quench system for rapid solidification.

The spherical nature of the particles are typical of gas atomization. An examination of the internal microstructure of the powder showed that there was a secondary dendrititic arm spacing of less than one micrometer. This indicates a cooling rate of 100,000° K./s, which is characteristic of gas atomization. The mean particle size for the resulting powders was 58 micrometers, which is considered to be relatively large. The characteristics of the resultant powders are ideal for the intended supersolidus sintering. Large particles with fine grain structure allows partial melting with an appropriately designed composition. These features provide optimum conditions for sintering to full density utilizing supersolidus sintering techniques.

Experiments were conducted on fifteen (15) alloys. These represent various Pd-Ag-Cu compositions containing different concentrations of the metalloids, boron and phosphorus and are listed in Table 1. The evaluation is aimed primarily at isolating the optimum composition. It was desireable to add polyethylene wax as a binder to form compacts. Due to the spherical shape and high hardness of the powder, there is little or no mechanical interlocking or cold bonding present to assist compaction. Pellets were hot compacted and subjected to debinding and presintering heat treatments. Debinding completely rids the sample of binder material which, if not removed, may be detrimental to successful sintering; presintering provides sufficient strength to handle the piece for subsequent sintering treatments. The optimized debinding cycle consisted of a heating rate of 1° K./min with holds at 140° C., 300° C. and 450° C. for one hour, respectively. This was followed by presintering at 600° C. for 60 minutes. Both cycles were conducted in a hydrogen atmosphere. At completion of this cycle, the samples which are now in the form of compacts were totally free of binder and had sufficient strength for subsequent handling.

The compacts were then sintered in a dry hydrogen atmosphere using a heating rate of 10° C./min up to 10° C. below the final sintering temperature. To avoid overshooting the final temperature, the heating rate was reduced to 3° C./min for the last 10° C. The compacts were held at temperature for 30 minutes. The final sintering temperature for the alloy identified as A1 was 830° C. It should be noted that in general a lower sintering temperature is associated with higher doping levels. The lower temperature reduces the loss of low density components which results in more uniform properties and microstructure. Lower temperatures also avoid detrimental grain growth.

Following sintering, the compacts were dimensioned and weighed for density measurements. No slumping was detected. This is an important finding since often liquid phase sintering results in distortion. Generally, the shrinkage was uniform except in the gravitational direction there was more shrinkage. The sintered densities for all of the alloys shown in Table 1 were over 92.5% of theoretical. In several instances, densities in excess of 100% were detected or measured. Special care was taken to ensure these were not errors in technique. A density greater than 100% of theoretical is explained by two possible reasons: The assumption of ideal solution of the alloy in the calculation may lead to deviation from the real density. Different crystal forms or the occurrence of interstitial atoms will make the actual density higher than the theoretical density. Additionally, the loss of low density components during thermal treatments may account for a higher actual density. This is possible with some of the ingredients in the alloy system. High densities are most often associated with higher content of B and P. The densities were measured on as-sintered samples/articles. That is there was no polishing or surface finishing performed. It was observed that removal of the surface layers resulted in slightly higher densities. This indicates the remaining porosity is probably in the near surface regions.

The hardness was measured on various samples sintered between 830° C. and 860° C. The hardness ranged from 49.7 to 50.1 HRC (Rockwell C scale) with a standard deviation of 0.3. Thus, there does not appear to be a sintering temperature effect on the hardness. For comparison, the palladium-silver-copper-gold-platinum alloys generally have a hardness below 40 HRC. The higher hardness in the alloys of this invention is a result of the alloying or doping with metalloids. The hardness measurements of the 15 alloys studied and reported on in Table 1 are given in HRB units (Rockwell B scale).

Measurements of the tensile strength and % elongation were also made on the A1 alloy. On a sample having a density of 99.3% theoretical (assuming a theoretical density of 10.24 g/cm$^3$ for the alloy) the transverse rupture strength was 1215 MPa and the tensile strength was 515 MPa with 0.6% elongation on a specimen or sample with a 98.2% density. The low ductility and high strength are not surprising considering these are as-sintered materials with considerable alloying and hardening (ordering) additions.

The measurements of the electrical resistivity demonstrated an obvious difference for the higher palladium alloys, A1–A5. The increase in palladium, thus decrease in silver or copper contents, resulted in increased resistivity. The high palladium alloys exhibited resistivities of 33–34 micro ohm-cm, whereas the high silver and copper alloys had resistivities ranging from 17.4 to 23.5 micro ohm-cm.

TABLE 1

| | ALLOY COMPOSITION Weight | | | | | ALLOY PROPERTIES Density Resistv'y | | Highest Hardness |
|---|---|---|---|---|---|---|---|---|
| Alloy | % Pd | % Ag | % Cu | % B | % P | % of Theory | Micro Ohm-Cm | In HRB |
| A1 | 40.0 | 30.0 | 30.0 | 0.5 | 0.5 | 101.2 | 34.3 | 98.3 |
| A2 | 40.0 | 30.0 | 30.0 | 0.25 | 0.25 | 99.0 | 30.7 | 98.9 |
| A3 | 40.0 | 30.0 | 30.0 | 0.75 | 0.75 | 96.0 | 31.8 | 99.4 |
| A4 | 40.0 | 30.0 | 30.0 | 0.25 | 0.75 | 97.3 | 32.6 | 94.1 |
| A5 | 40.0 | 30.0 | 30.0 | 0.75 | 0.25 | 97.5 | 22.7 | 95.8 |
| B1 | 30.0 | 30.0 | 40.0 | 0.5 | 0.5 | 99.5 | 21.4 | 90.5 |
| B2 | 30.0 | 30.0 | 40.0 | 0.25 | 0.25 | 99.4 | 20.4 | 91.3 |
| B3 | 30.0 | 30.0 | 40.0 | 0.75 | 0.75 | 100.3 | 21.3 | 88.6 |
| B4 | 30.0 | 30.0 | 40.0 | 0.25 | 0.75 | 98.9 | 19.3 | 84.8 |
| B5 | 30.0 | 30.0 | 40.0 | 0.75 | 0.25 | 100.0 | 19.6 | 90.5 |
| C1 | 30.0 | 40.0 | 30.0 | 0.5 | 0.5 | 100.6 | 21.9 | 93.9 |
| C2 | 30.0 | 40.0 | 30.0 | 0.25 | 0.25 | 97.0 | 23.5 | 81.5 |
| C3 | 30.0 | 40.0 | 30.0 | 0.75 | 0.75 | 99.6 | 17.4 | 89.7 |
| C4 | 30.0 | 40.0 | 30.0 | 0.25 | 0.75 | 92.5 | 22.8 | 79.8 |
| C5 | 30.0 | 40.0 | 30.0 | 0.75 | 0.25 | 98.7 | 17.9 | 78.7 |

Table 2 below compares the A1 alloy of the invention with commercially available alloys, such as the traditional Pd-Ag-Cu-Au-Pt alloys (known as the Paliney alloys), relative to the various properties of interest. Alloy A1 containing 40 wt. % Pd, 30 wt. % Ag and 30 wt. % Cu with 0.5% B and 0.5% P by weight offers the most favorable combination of properties for use in electrical contacts. The material is homogeneous with respect to porosity and physical properties. Furthermore, this composition offers high density and hardness combined with good resisitivity which makes it ideal for electrical contact applications. The Table 2 compares the mechanical and electrical properties of alloy A1 with those Pd-Ag-Cu alloys formed using traditional metallurgy techniques.

TABLE 2

| PROPERTY | COMMERCIAL ALLOYS | ALLOY A1 |
|---|---|---|
| Resistivity, micro ohm-cm | 25 to 35 | 27 to 33 |
| Ultimate Tensile Strength MPa | 380 to 1000 | 515 |
| Elongation, % | 1 to 20 | 0.6 |
| Hardness, HRC | <40 | 20 to 50 |

The present invention is not to be restricted in form nor limited in scope except by the claims appended hereto:

What we claim is:

1. An alloy composition of matter comprising: at least one noble metal selected from the group consisting of gold, palladium, silver and copper; and an amount of between about 0.20 weight percent and about 0.80 weight percent of at least one metalloid selected from the group of metalloids consisting of boron, phosphorous, silicon and lithium.

2. A noble metal alloy comprising: an amount of between about 5.0 weight percent and about 60.0 weight percent palladium; an amount of between about 5.0 weight percent and about 60.0 weight percent silver; an amount of between about 5.0 weight percent and about 60.0 weight percent copper; an amount of between about 0.05 weight percent and about 0.80 weight percent boron; and an amount of between about 0.05 weight percent and about 0.80 weight percent phosphorous.

3. A noble metal alloy comprising: not less than 20.0 weight percent palladium; not less than 20.0 weight percent silver; not less than 20.0 weight percent copper; not less than 0.20 weight percent boron; and not less than 0.20 weight percent phosphorous.

4. A noble metal alloy comprising: between about 30.0 and about 40.0 weight percent palladium; between about 30.0 and about 40.0 weight percent silver; between about 30.0 and about 40.0 weight percent copper; between about 0.25 and about 0.50 weight percent boron; and between about 0.25 and about 0.50 weight percent phosphorous.

5. The noble metal alloy as recited in claim 1, 2, 3 or 4 wherein said alloy is in the form of a substantially spherical particle a plurality of said particles being a metal powder.

6. The noble metal alloy as recited in claim 5 wherein said metal powder is produced by gas atomization and said particle size is less than about 100 micrometers wherein said particles are comprised of grains having a grain size less than about 10 micrometers.

* * * * *